US010439335B2

(12) United States Patent
Hieber

(10) Patent No.: US 10,439,335 B2
(45) Date of Patent: Oct. 8, 2019

(54) ELECTRICAL PLUG CONNECTOR WITH AN ELECTRICAL CONTACT FOR GROUNDING A HOUSING

(71) Applicant: PHOENIX CONTACT Connector Technology GmbH, Herrenberg (DE)

(72) Inventor: Alexander Hieber, Herrenberg (DE)

(73) Assignee: PHOENIX CONTACT Connector Technology GmbH, Herrenberg (DE)

( * ) Notice: Subject to any disclaimer, the term of this patent is extended or adjusted under 35 U.S.C. 154(b) by 0 days.

(21) Appl. No.: 16/072,275

(22) PCT Filed: Dec. 28, 2016

(86) PCT No.: PCT/DE2016/100616
§ 371 (c)(1),
(2) Date: Jul. 24, 2018

(87) PCT Pub. No.: WO2017/129161
PCT Pub. Date: Aug. 3, 2017

(65) Prior Publication Data

US 2019/0036277 A1 Jan. 31, 2019

(30) Foreign Application Priority Data

Jan. 28, 2016 (DE) ..... 10 2016 101 518

(51) Int. Cl.
*H01R 13/6597* (2011.01)
*H01R 13/652* (2006.01)
(Continued)

(52) U.S. Cl.
CPC ..... *H01R 13/6597* (2013.01); *H01R 13/652* (2013.01); *H01R 24/30* (2013.01); *H01R 2107/00* (2013.01)

(58) Field of Classification Search
CPC .. H01R 13/6597; H01R 13/652; H01R 24/30; H01R 2107/00; H01R 13/65802;
(Continued)

(56) References Cited

U.S. PATENT DOCUMENTS 5,151,035 A 9/1992 Kawai et al.
5,169,323 A * 12/1992 Kawai ..... H01R 13/648 439/108
(Continued)

FOREIGN PATENT DOCUMENTS

DE 39 12 189 A1 5/1992
DE 44 12 173 A1 10/1994
(Continued)

OTHER PUBLICATIONS

International Search Report for corresponding App. No. PCT/DE2016/100616, dated Apr. 6, 2017.
(Continued)

*Primary Examiner* — Travis S Chambers
(74) *Attorney, Agent, or Firm* — Renner, Otto, Boisselle & Sklar, LLP

(57) ABSTRACT

A multi-pole electric plug connector including a metallic housing. To ensure protective grounding of the housing, a bracket-shaped electrically conducting connector, which is resilient in the axial direction and laterally extends around a contact holder in the housing, and which is axially elastically pushed down by the housing so that contact is made with the housing, and through which a grounding contact extends so as to connect the housing to the grounding contact in an electrically conducting manner.

11 Claims, 8 Drawing Sheets

(51) Int. Cl.
*H01R 24/30* (2011.01)
*H01R 107/00* (2006.01)

(58) Field of Classification Search
CPC ..... H01R 13/6596; H01R 13/648; H01R 13/6485; H01R 13/6582
USPC ..... 439/108, 92, 95, 607.28
See application file for complete search history.

(56) References Cited

U.S. PATENT DOCUMENTS 5,181,860 A * 1/1993 Honma ..... H01R 13/623 285/82
5,281,149 A * 1/1994 Petri ..... H05K 7/142 174/138 D
2008/0214028 A1 9/2008 Bartholoma

FOREIGN PATENT DOCUMENTS

DE 591 09 409 T2 2/1996
DE 20 2005 012756 U1 10/2005

OTHER PUBLICATIONS

German Search Report for corresponding German Patent Application No. 10 2016 101 518.0 dated Sep. 30, 2016.

* cited by examiner

ELECTRICAL PLUG CONNECTOR WITH AN ELECTRICAL CONTACT FOR GROUNDING A HOUSING

TECHNICAL FIELD OF INVENTION

The invention relates to an electric plug connector having the features described herein.

DISCUSSION OF RELATED ART

Electric plug connectors are known. These can comprise one or multiple poles and are used to connect single-pole or multi-pole electrical cables by inserting or plugging a plug connector into a coupling, or two plug connectors. If plug connectors comprise a metallic housing or, generally speaking, one or more metallic or otherwise electrically conductive parts that are disposed on the outside or, in any case, so as to be exposed, the problem of protecting against electrical shock arises. One safety measure is protective grounding, which is to say an electrically conducting connection between exterior or, in any case, exposed electrically conducting parts and a protective ground conductor.

The patent DE 39 12 189 C2 discloses an electric plug connector in the form of a cylindrical multi-pole circular plug connector comprising a sleeve-shaped metallic housing, which makes protective grounding possible. A cylindrical, electrically insulating contact holder made of plastic material is disposed in the sleeve-shaped metallic housing, multiple electrical contacts being held therein in an axially parallel manner, and thus in a plug-in direction of the plug connector, one of which serves as a grounding contact. The electrically insulating contact holder is surrounded by an annular electric connector, which is open in one circumferential area and resilient in the radial direction and which bears against the inside of the metallic housing of the plug connector under an elastic preload, and thereby makes electrically conducting contact with the housing. In one circumferential area, the electrically conducting connector is bent inwardly in a U-shaped manner, and rests against the grounding contact there, whereby the metallic housing of the plug connector is connected to the grounding contact in an electrically conducting manner.

It is the object of the invention to propose an electric plug connector of the type described above, which is improved in terms of assembly and/or installation space.

SUMMARY OF THE INVENTION

This object is achieved by an electric plug connector having the features described herein. The plug connector according to the invention comprises one or more electrical contacts, which, in respective pairs, make electrically conducting contact with mating contacts of the coupling, the mating connector or the like, as a result of the plug connector being inserted or plugged into a coupling, mating connector or the like. The electrical contact or contacts of the plug connector according to the invention is or are held by an electrically insulating contact holder, and one of the electrical contacts is connected in an electrically conducting manner to a metallic housing or, generally speaking, an electrically conducting part of the plug connector, which is disposed on the outside or, in any case, in an exposed manner on the plug connector. The electrical contact connected electrically to the housing or the electrically conducting part can be used as a grounding contact for protective grounding of the metallic housing or, generally speaking, of the electrically conducting part of the plug connector. When the plug connector according to the invention is assembled, the contact holder and the housing, or the electrically conducting part, are moved relative to one another in a plug-in direction of the plug connector, wherein an electrically conducting connector becomes seated against the housing or the electrically conducting part, and thereby establishes an electrically conducting connection with the metallic housing or, generally speaking, the electrically conducting part of the plug connector. The plug-in direction of the plug connector is the direction in which the plug connector is inserted or plugged into a coupling, a mating connector or the like. For the electrically conducting connection to the electrically conducting connector, the electrically conducting part comprises a contact surface extending transversely to the plug-in direction of the plug connector. Due to the relative movement of the electrically conducting part with respect to the contact holder during assembly or joining of the electric plug connector, the contact surface of the electrically conducting part is caused to bear against, and thereby make electrical contact with, the electrically conducting connector, which connects the one electrical contact of the plug connector to the electrically conducting part of the plug connector in an electrically conducting manner to as to enable protective grounding. The contact surface does not have to run exactly transversely with respect to the plug-in direction of the plug connector, but may also run at an acute angle with respect to the transverse direction. It is essential for the invention that the contact surface of the electrically conducting part of the plug connector strikes against the electrically conducting connector when the plug connector is joined in the plug-in direction. The contact surface of the electrically conducting part, and in particular of a metallic housing of the plug connector according to the invention, is preferably formed by an end face of the electrically conducting part, which during joining in the plug-in direction of the plug connector strikes against the electrically conducting connector.

The invention requires less space for the electrically conducting connector in the plug-in direction for the purpose of protective grounding, which makes it possible, for example, to provide an O-ring and/or coding on the contact holder, without making the plug connector longer. The joining of the plug-in connector is improved by the contact holder not striking against an annular electrically conducting connector, and then having to be pushed through the connector, but rather only being moved to bear against the electrically conducting connector in the plug-in direction. The plug connector can thus be smoothly joined to the electrically conducting connector without "jamming."

As was already described, one embodiment of the plug connector according to the invention comprises a metallic housing, which serves as the electrically conducting part and is connected in an electrically conducting manner to an electrical contact of the plug connector by the electrically conducting connector.

For connecting the electrically conducting connector to the electrical contact, mechanically and in an electrically conducting manner, one embodiment of the invention provides a passage in the electrically conducting connector, through which the electrical contact passes. This enables both easy assembly and a permanently reliable electrically conducting connection between the electrical contact and the electrically conducting connector.

In a preferred embodiment, the electrically conducting connector is resilient in the plug-in direction of the plug connector and consequently bears with a mechanical preload against the electrically conducting part in the plug-in direction. In this way, a reliable electrically conducting connection between the electrically conducting part of the plug connector and the electrically conducting connector is achieved, along with a production and assembly tolerance in the plug-in direction of the electric plug connector, which is also the assembly direction.

One embodiment of the invention provides that the plug connector comprises an abutment for the electrically conducting connector, on which the electrically conducting connector is supported in the plug-in direction, which is also the assembly direction. The abutment may be an annular shoulder or a flange on the contact holder, for example, wherein other abutments are not precluded. The metallic housing or, generally speaking, the electrically conducting part of the plug connector according to the invention, bears against the electrically conducting connector at a distance from the abutment, or from the area or areas on which the electrically conducting connector is supported on the abutment. The abutment allows the electrically conducting connector to be resilient in the plug-in direction of the plug connector. As a result of the electrically conducting part of the plug connector bearing against the electrically conducting connector at a distance from the abutment, and with preload in the plug-in direction, the electrically conducting part causes a tilting moment on the electrically conducting connector, which is thus tilted on the electrical contact with a passage, for example, whereby a permanent electrically conducting connection is reliably achieved between the electrically conducting connector and the electrical contact.

One embodiment of the invention provides for a bracket-shaped electrically conducting connector, which is produced in the form of a metal stamped and bent part, for example, and due to the bracket shape comprises two spring legs, which laterally extend around the contact holder and bear with an elastic preload against the electrically conducting part in the plug-in direction of the plug connector. This embodiment of the invention is less expensive to produce, easier to assemble, and space-saving in the plug-in direction.

BRIEF DESCRIPTION OF THE DRAWINGS

The invention will be described hereafter in greater detail based on one exemplary embodiment shown in the drawings. In the drawings.

DETAILED DESCRIPTION OF THE INVENTION

Figure 1:
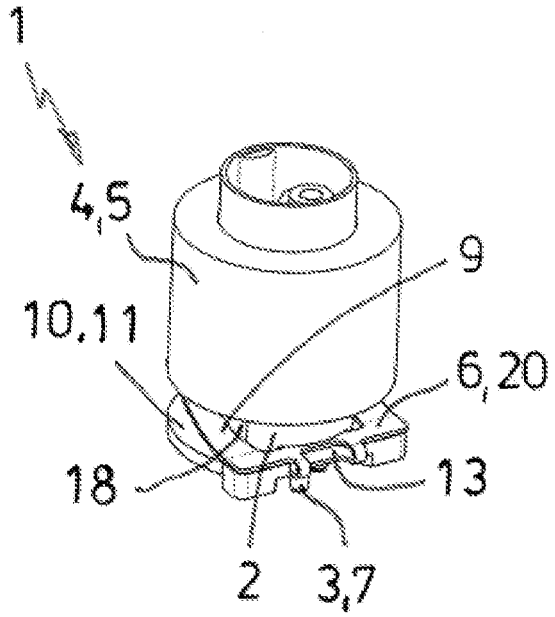
FIGS. 1 and 2 show an electric plug connector according to the invention in perspective illustrations from different viewing directions.
Figure 2:
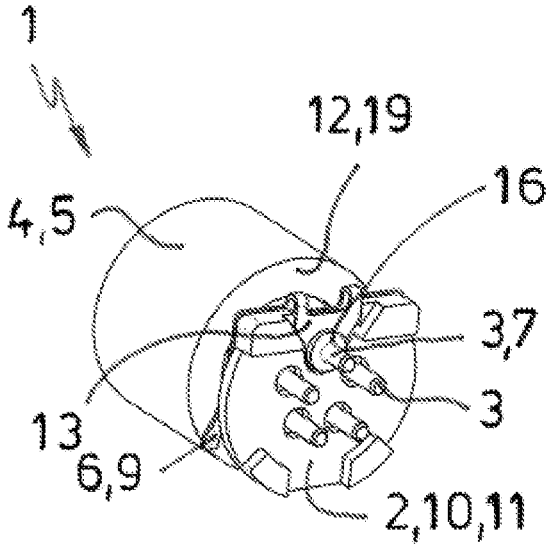
Figure 3:
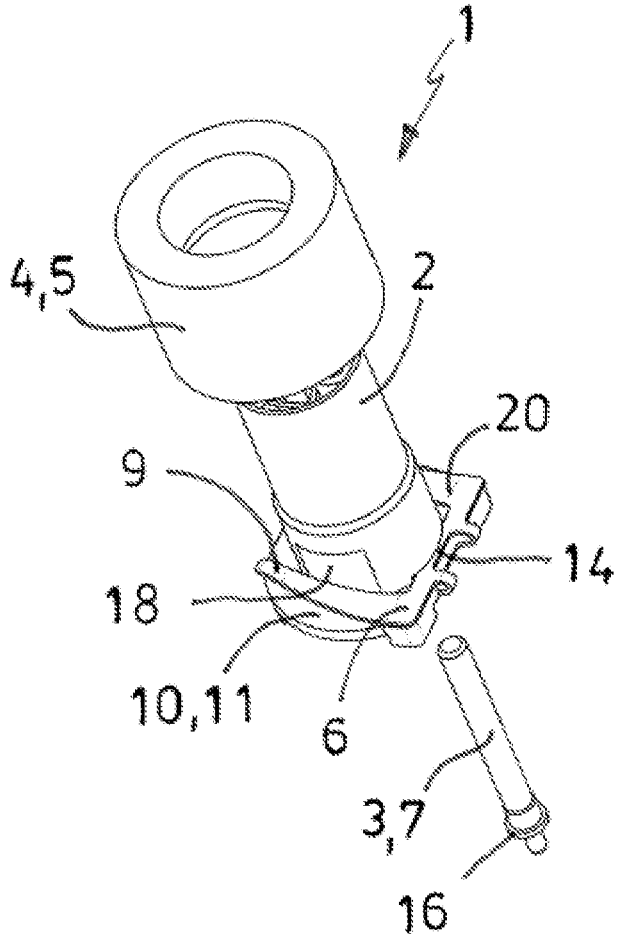
FIGS. 3 and 4 show the plug connector from FIGS. 1 and 2 in exploded perspective views from different viewing directions.
Figure 4:
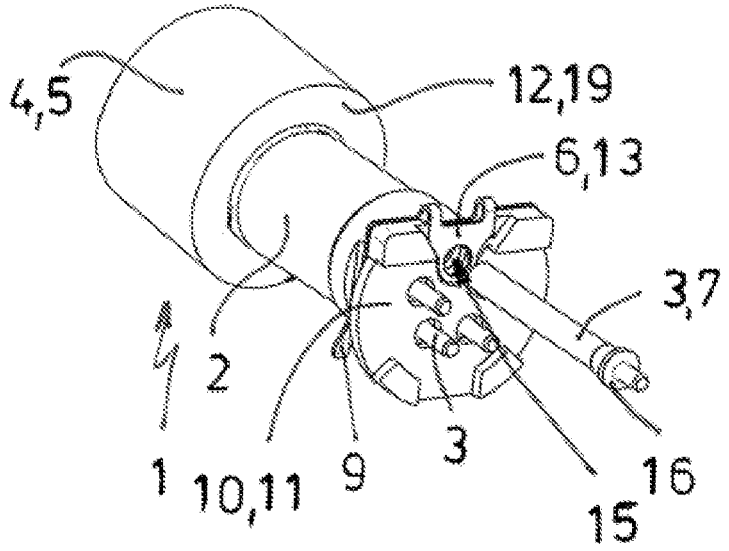
Figure 5:
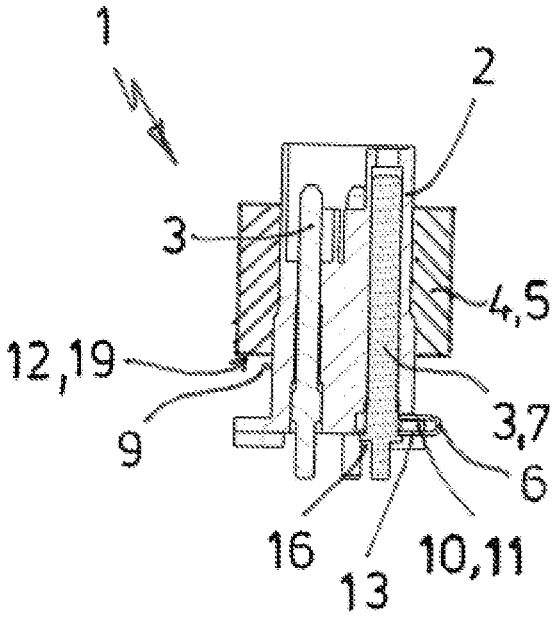
FIG. 5 shows an axial section of the plug connector from FIGS. 1 and 2.

The electric plug connector 1 according to the invention shown in the drawings is a multi-pole circular connector in exemplary embodiment that is shown and described, however this is not mandatory for the invention. This comprises an electrically insulating contact holder 2 made of plastic material, which has a cylindrical basic shape. The contact holder 2 holds electrical contacts 3 and is surrounded by a sleeve-shaped metallic housing 4, wherein the electrically insulating contact holder 2 surrounds each of the contacts 3 individually and in the housing 4, so that the contacts 3 are electrically insulated from one another and from the housing 4. The housing 4 may, general speaking, also be considered to be an electrically conducting part 5 of the plug connector 1, which is disposed on the outside of the plug connector 1 and thus exposed.

In the exemplary embodiment, the plug connector 1 comprises 5 poles, having five electrical contacts 3 disposed in corners of an imaginary equilateral pentagon, seen axially. The number and arrangement of the contacts 3 is not essential for the invention. In the exemplary embodiment, the contacts 3 are metal pins, which are pressed into through-holes in the contact holder 2 in an axially parallel manner, and thereby held by the contact holder 2. One of the contacts 3 is connected in an electrically conducting manner to the housing 4 via an electrically conducting connector 6. This enables protective grounding of the housing 4 and is, hereafter, also referred to as the grounding contact 7. Metal pins are not mandatory for the invention, and the contacts 3 may also be blade contacts or bushings, for example, and the contacts 3 may be different.

Figure 6:
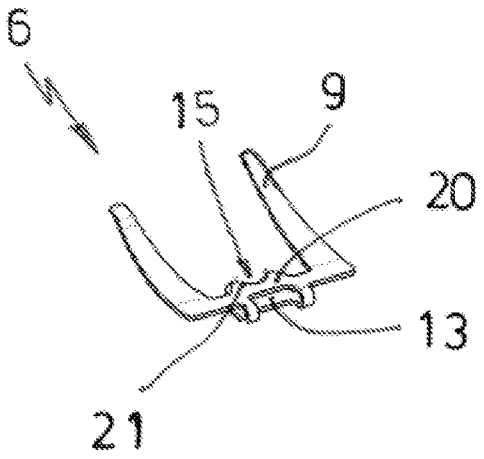
FIG. 6 shows a perspective illustration of an electric connector of the plug connector from FIGS. 1 to 5.

The electrically conducting connector 6 is a bracket-shaped, stamped and bent metal part that, due to the bracket shape thereof, comprises two spring legs 9 (FIG. 6), which laterally extend around the contact holder 2 on opposing sides. The electrically conducting connector 6 rests on a flange 10 of the contact holder 2, which forms an abutment 11 for the electrically conducting connector 6, which axially supports the electrically conducting connector 6. Axial refers to a plug-in direction of the plug connector 1 during insertion into a coupling, which is not shown, or during joining with a mating connector, which is not shown. The flange 10 forming the abutment 11 thus supports the electrically conducting connector 6 in the plug-in direction of the plug connector 1.

Figure 7:
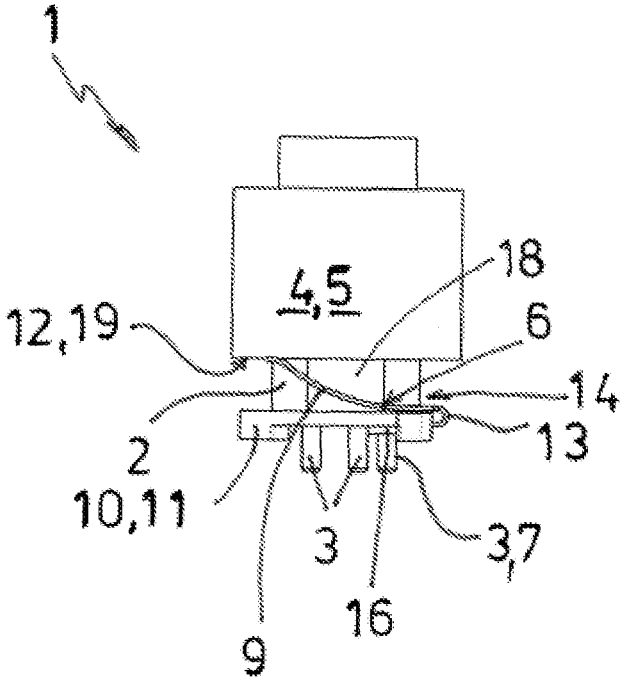
FIGS. 7 and 8 show the plug connector from FIGS. 1 to 5 in a side view with a partially (FIG. 7) and completely (FIG. 8) attached housing.
Figure 8:
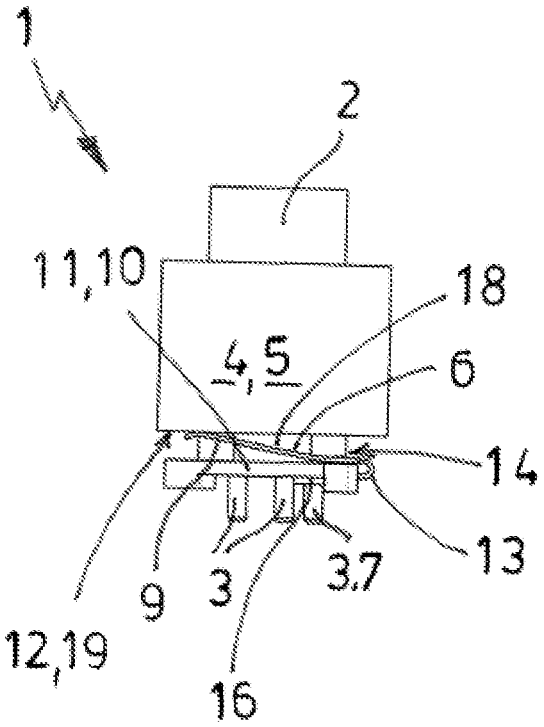

The spring legs 9 of the electrically conducting connector 6 extending laterally around the contact holder 2 are bent, having a curvature so that, when not deformed (FIG. 7), these project obliquely away from the flange 10 in the direction of the housing 4 at an acute angle, which varies over a length of the spring legs 9. When the housing 4, during assembly, is placed on the contact holder 2, an edge 12 of the housing 4 is caused to bear against free ends of the spring legs 9 of the electrically conducting connector 6 and elastically acts on the spring legs 9 in, or counter to, the plug-in direction of the plug connector 1 toward the flange 10 of the contact holder 2 forming the abutment 11 for the electrically conducting connector 6. In this way, the housing 4 of the plug connector 1 is connected to the electrically conducting connector 6 in an electrically conductive manner. The edge 12 of the housing 4 forms a contact surface 19, which bears against the spring legs 9 of the electrically conducting connector 6 so that the housing 4 is connected to the electrically conducting connector 6 in an electrically conducting manner.

Since the spring legs 9 are resilient in the axially parallel direction, and thus in the assembly and plug-in direction of the plug connector 1, with comparatively large spring travel, high compensation for manufacturing and assembly tolerances is ensured, and the electrically conducting connection between the housing 4 and the electrically conducting connector 6 is reliably and permanently ensured.

With the exception of the electrically conducting connector 6 that is inserted laterally into, or onto, the contact holder 2, which will be described hereafter, the assembly of the plug connector 1, namely the pressing of the contacts 3 into the contact holder 2 and the placement of the housing 4 onto the contact holder 2, takes place in an axially parallel or axial direction, which is also the plug-in direction of the plug connector 1 during insertion into a coupling or during joining with a mating connector. The assembly involves a relative movement of the contact holder 2, the contacts 3, and the housing 4 with respect to one another in an axially parallel, or axial, direction, which is also the plug-in direction of the plug connector 1. The assembly of the plug connector 1 may also be considered a joining of the parts thereof.

The electrically conducting connector 6 comprises a tab 13 in a center of a yoke 20 connecting the spring legs 9 thereof, the tab projecting outwardly and being bent inwardly in a U-shaped manner after the connector 6 has been stamped. For assembly, the electrically conducting connector 6 is placed laterally onto the contact holder 2, before the contacts 3 or, in any case, before the grounding contact 7 is pressed into the contact holder 2, so that the two spring legs 9 extend laterally around the contact holder 2 on mutually opposing sides. The tab 13 of the electrically conducting connector 6 thus reaches a back side of the flange 10 of the contact holder 2 which faces away from the housing 4, while the yoke 20 and the spring legs 9 are located on a front side of the flange 10 which faces the housing 4. The flange 10 of the contact holder 2 is located between the spring legs 9 on one side, and the tab 13 and the yoke 20 on the other, so the electrically conducting connector 6 is held mechanically on the contact holder 2.

In the tab 13, the electrically conducting connector 6 comprises a passage 15 for the grounding contact 7, which is aligned with a semi-circular bearing surface 21 for the grounding contact 7 in the center of the yoke 20 of the connector 6. The grounding contact 7 is pressed through the passage 15 of the electrically conducting connector 6 into the axially parallel through-hole of the contact holder 2 provided therefor, and bears against the bearing surface 21, in addition to the passage 15. The grounding contact 7 is thus connected to the electrically conducting connector 6 in an electrically conducting manner and, via the electrically conducting connector 6, the housing 4 is connected to the grounding contact 7 of the plug connector 1 in an electrically conducting manner, which makes protective grounding of the housing 4 possible.

For a reliable and easily electrically conducting connection between the electrically conducting connector 6 and the grounding contact 7, the grounding contact 7 comprises a flange 16, which bears against the tab 13 of the electrically conducting connector 6. An additional measure for an easily electrically conducting connection between the electrically conducting connector 6 and the grounding contact 7 is to design the passage 15 of the electrically conducting connector 6 with an undersized dimension compared to the grounding contact 7 and/or to provide the bearing surface 21 with an offset in relation to the passage 15 in the direction of the grounding contact 7 and/or in relation to the axially parallel through-hole in the contact holder 2, into which the grounding contact 7 is pressed. These measures ensure that the grounding contact 7 bears with a contact force against the bearing surface 21 and against an opposite side of the passage 15 of the electrically conducting connector 6. The elastic deformation of the spring legs 9 of the electrically conducting connector 6 effectuated by the housing 4 pressing against these in the plug-in direction of the plug connector 1 subjects the electrically conducting connector 6 to a bending load, which likewise causes a contact force of an edge of the passage 15 of the electrically conducting connector 6 in the center between the two spring legs 9 thereof against the grounding contact 7. Furthermore, the housing 4 bears against the free ends of the spring legs 9, and thus at a distance from the area in which the electrically conducting connector 6 is supported on the flange 10 forming the abutment 11. This causes a tilting moment on the electrically conducting connector 6, which likewise causes a contact force of the bearing surface 21 and of the edge of the passage 15 of the electrically conducting connector 6 against the grounding contact 7. To achieve an easily electrically conducting connection between the electrically conducting connector 6 and the grounding contact 7, in principle one or any arbitrary combination of the aforementioned measures suffices, and it is not necessary to implement all of the aforementioned measures.

In the axial direction, which is to say in the plug-in direction of the plug connector 1, the electrically conducting connector 6 requires installation space measuring only approximately the thickness thereof, or approximately twice to approximately three times the thickness thereof. This makes it possible to provide an O-ring or other sealing ring (not shown) in a peripheral groove of the contact holder 2, without increasing a length of the plug connector 1 in the axial and plug-in direction. It is likewise possible to provide a labeling field 18 for attaching a label, code or the like on a side of the flange 10 of the contact holder 2 which faces the housing 4, without increasing the length of the plug connector 1.

The invention claimed is:

1. An electric plug connector, comprising an electrical contact, an electrically insulating contact holder, which holds the electrical contact, an electrically conducting part, which is assembled with the contact holder by way of a relative movement with respect to the contact holder in a plug-in direction of the plug connector, and an electrically conducting connector, which connects the electrical contact to the electrically conducting part of the plug connector in an electrically conducting manner, wherein the electrically conducting part comprises a contact surface extending transversely to the plug-in direction of the plug connector, which is in contact with the electrically conducting connector during assembly of the electric plug connector due to the relative movement of the electrically conducting part with respect to the contact holder; and wherein the contact surface is an end face of the electrically conducting part.

2. The electric plug connector according to claim 1, wherein the electrically conducting part is a housing of the plug connector in which the contact holder is accommodated.

3. The electric plug connector according to claim 1, wherein the electrically conducting connector has a passage through which the electrical contact extends.

4. The electric plug connector according to claim 1, wherein the electrically conducting connector is resilient in the plug-in direction of the plug connector, and bears against the electrically conducting part with a mechanical preload in the plug-in direction.

5. The electric plug connector according to claim 1, wherein the electrically conducting connector is bracket-shaped and comprises two spring legs, which extend laterally around the contact holder and bear with a mechanical preload against the electrically conducting part in the plug-in direction of the plug connector.

6. The electric plug connector according to claim 1, wherein the plug connector comprises an abutment for the electrically conducting connector, on which the electrically conducting connector is supported against application force from the electrically conducting part in the plug-in direction of the plug connector, and the electrically conducting part bears against the electrically conducting connector at a distance from the abutment.

7. An electric plug connector, comprising an electrical contact, an electrically insulating contact holder, which holds the electrical contact, an electrically conducting part, which is assembled with the contact holder by way of a relative movement with respect to the contact holder in a plug-in direction of the plug connector, and an electrically conducting connector, which connects the electrical contact to the electrically conducting part of the plug connector in an electrically conducting manner, wherein the electrically conducting part comprises a contact surface extending transversely to the plug-in direction of the plug connector, which is in contact with the electrically conducting connector during assembly of the electric plug connector due to the relative movement of the electrically conducting part with respect to the contact holder; and wherein the plug connector comprises an abutment for the electrically conducting connector, on which the electrically conducting connector is supported against application force from the electrically conducting part in the plug-in direction of the plug connector, and the electrically conducting part bears against the electrically conducting connector at a distance from the abutment.

8. The electric plug connector according to claim 7, wherein the electrically conducting part is a housing of the plug connector in which the contact holder is accommodated.

9. The electric plug connector according to claim 7, wherein the electrically conducting connector has a passage through which the electrical contact extends.

10. The electric plug connector according to claim 7, wherein the electrically conducting connector is resilient in the plug-in direction of the plug connector, and bears against the electrically conducting part with a mechanical preload in the plug-in direction.

11. The electric plug connector according to claim 7, wherein the electrically conducting connector is bracket-shaped and comprises two spring legs, which extend laterally around the contact holder and bear with a mechanical preload against the electrically conducting part in the plug-in direction of the plug connector.

* * * * *